United States Patent [19]

Ruckstuhl

[11] Patent Number: 4,869,660

[45] Date of Patent: Sep. 26, 1989

[54] APPARATUS FOR FABRICATION OF CONCRETE BRICK

[76] Inventor: Willi Ruckstuhl, Augwilerstrasse 48, CH 8302 Kloten, Switzerland

[21] Appl. No.: 202,201

[22] Filed: Jun. 3, 1988

[30] Foreign Application Priority Data

Jun. 5, 1987 [CH] Switzerland ..... 2133/87

[51] Int. Cl.[4] ..... B28B 21/12; B28B 21/14

[52] U.S. Cl. ..... 425/195; 425/413; 425/421; 425/423; 425/431; 425/456

[58] Field of Search ..... 425/420, 423, 431, 412, 425/413, 421, 195, 193, 456, 432; 249/140

[56] References Cited

U.S. PATENT DOCUMENTS

| | | | |
|---|---|---|---|
| 799,754 | 9/1905 | Petrie | 249/140 |
| 1,564,490 | 12/1925 | Parkhurst | 425/421 |
| 1,776,999 | 9/1930 | Jensen | 249/140 |
| 2,038,205 | 4/1936 | Case | 425/423 |
| 3,013,321 | 12/1961 | McElroy | 425/421 |
| 3,277,551 | 10/1966 | Sekiguchi | 425/421 |
| 4,063,866 | 12/1977 | Lurbiecki | 425/431 |

*Primary Examiner*—Willard Hoag

*Attorney, Agent, or Firm*—Willian, Brinks, Olds, Hofer, Gilson & Lione

[57] ABSTRACT

Apparatus for making a concrete brick, the brick having at least one visible surface having a texture similar to that of natural stone. The brick may be made by filling a mold with concrete, vibrating the mold, and using a descending plunger to compress the concrete in the filled mold. At least one interior surface of the mold has a textured surface used to form the texture in the brick. Following compression of the concrete, a movable sidewall of the mold is moved laterally away from the brick a distance sufficient for the textured surface of the mold wall to clear the textured surface of the brick when the mold is raised. With the plunger remaining in place, the mold is raised, following which the plunger is raised.

5 Claims, 6 Drawing Sheets

APPARATUS FOR FABRICATION OF CONCRETE BRICK

BACKGROUND OF THE INVENTION

Many different cast concrete moldings are known. Such pre-cast bricks are used to build free-standing or retaining walls. The present invention concerns a new pre-cast brick of this type and a process and apparatus for the industrial manufacture of the brick. The conventional manner of manufacturing such concrete elements is to cast them in varied shapes by means of a special apparatus. This is principally done using a box-shaped mold with the negative shape of the finished element on the inside. This mold is placed on a support board, the board being pushed onto a vibrating table by a special board carriage running on tracks. The table functions as a main vibrator and is located beneath the support board. The mold cavity is then filled with concrete. This is done by a mobile hopper which is loaded automatically from a storage tank containing ready-mixed concrete. Concrete passes from the storage tank into the mobile hopper through a spout. As soon as the mold is full of concrete, the mobile hopper is moved back into position beneath the storage tank spout, and a plunger descends upon the concrete in the mold. The cross-section of the plunger is identically matched to the top outside surface of the finished molding. Usually the plunger is hydraulically pressed down on the concrete in the mold. Simultaneously, it also works as a vibrator at the top of the mold, while a main vibrator located under the bottom of the mold. i.e., beneath the board carriage, works together with the vibrations from the plunger. Thus, vibration comes from both above and below at the same time as the plunger is being pushed down, resulting in substantial compression of the concrete in the mold. Every angle and corner of the mold is thus optimally filled with concrete. As a result of the compression, the concrete reaches a level of hardness that permits immediate de-molding of the finished element. To this end, the mold is raised vertically along the plunger and over it, while the plunger itself remains in position, pressing down the concrete. As soon as the lower edge of the mold has been raised above the plunger surface, the plunger is carried along by the mold and raised with it. The finished pre-cast brick now remains in its de-molded form on the support board and is pushed away by the board carriage for onward transportation by a conveyor system. The empty board carriage is then moved back into position. On its return journey, it pushes another support board onto the main vibrator. Now, the box mold is lowered back onto the support board and re-filled with concrete. In this conventional process, the pre-cast element is always vertically de-molded by raising the mold perpendicularly. It is the inside surfaces of the mold that determine what kind of external side and visible upper surfaces the finished element will have, with the exception of the top. Due to the vertical movement of the mold during de-molding, it is not possible to shape any surfaces of the finished casting other than those listed above.

To build retaining walls at varying angles of incline, special retaining wall elements in the shape of an open trough, for example, may be used. The individual elements are built into the slope which is to be retained starting from the bottom and working up. The layers of these elements usually recede somewhat, which means that each succeeding level is slightly further back than the one beneath it by a distance determined by the steepness of the slope. The elements themselves have stops which effectively prevent one element from being pushed out in front of the one below it. At the same time, these stops determine the maximum angle of incline that can be retained with elements of that particular kind. It would be especially desirable for the purpose of building up retaining systems for slopes to have elements with an overhanging front, because this would make it possible to retain much steeper slopes.

Conventional pre-cast elements have smooth sides due to the manner of the fabrication process, because the mold scrapes along these sides during de-molding. If these smooth sides remain visible in a retaining wall, their appearance is bare, artificial and unattractive.

It is desirable, therefore, to make pre-cast elements with variously textured visible surfaces, which would give a general appearance of natural stone. Until now, it has not been possible to manufacture a pre-cast concrete brick with, for instance, an overhanging and textured visible front, due to the fact that the mold is removed vertically upwards.

SUMMARY OF THE INVENTION

In a process according to the current invention, a box-shaped mold is positioned on a support surface. The mold has at least one movable sidewall having a textured surface disposed interior of the mold. The mold is filled with concrete. Then, the concrete in the filled mold is pressed from above with a plunger and is vibrated in order to form a concrete brick. The sidewall is then moved away from the brick, and the mold is raised while the plunger retains the concrete brick on the support surface. Then the plunger is raised, releasing the brick.

Apparatus according to the current invention comprises a box-shaped mold for receiving concrete, the box being adapted to rest on a support surface. The mold has a plurality of sidewalls, at least one of which is movable, and a textured interior surface. A plunger is provided and disposed so as to press the concrete in the mold from above. At least one vibrator is provided for vibrating the concrete in the mold. Means are provided for moving the mold vertically to and from the support surface while the plunger is stationary.

The invention also includes a concrete brick made according to the inventive process, the brick being characterized by at least one visible surface having a texture similar to that of natural stone.

A purpose of this invention is to create a casting of the said type and a process and the apparatus for the fabrication thereof which would make possible the manufacture of a pre-cast brick with a textured front or an overhanging front, or both.

The pre-cast concrete brick according to the invention and the process according to the invention are explained with reference to the drawings. The drawings also illustrate the description of an example of an apparatus for the execution of the said process.

BRIEF DESCRIPTION OF THE DRAWINGS

FIG. 7(*b*) is a front elevation of the wall of FIG. 7(*a*), the soil being omitted for clarity;

FIG. 8(*b*) is a front elevation of the wall of FIG. 8(*a*); and

DETAILED DESCRIPTION OF THE PREFERRED EMBODIMENTS

Figure 1:
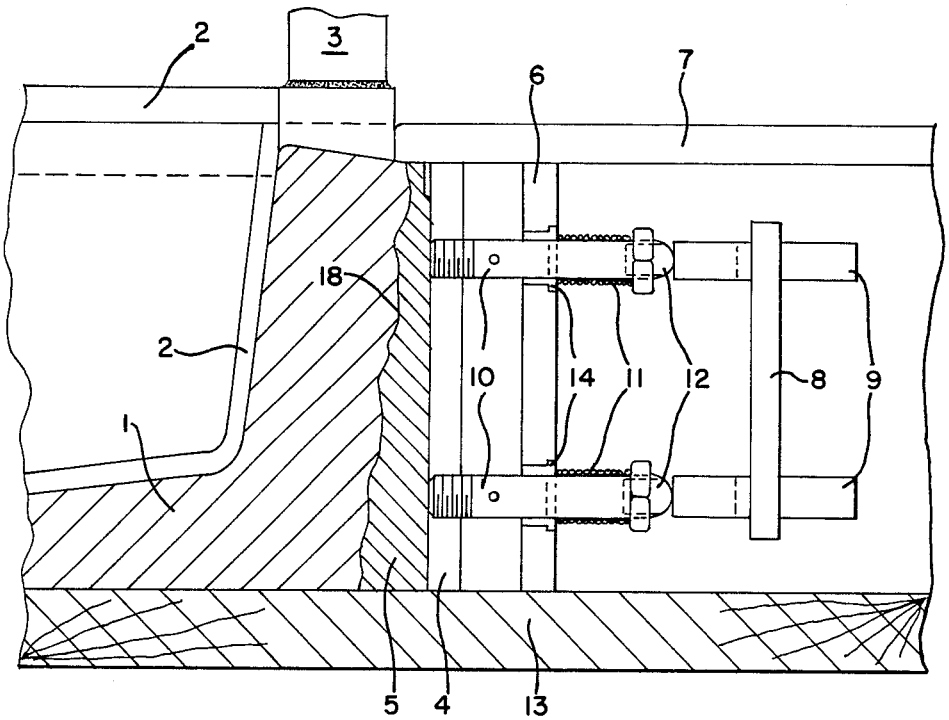
FIG. 1 is a fragmentary elevation, partly in section, showing a movable sidewall of a box mold being pressed against the front face of a concrete brick being molded.

The main components of the apparatus according to the invention for executing the process according to the invention are portrayed in FIG. 1. Movable sidewall 4 of a box mold can be seen on a support board 13, which rests on a so-called board carriage and can thus be moved horizontally from side to side. In the figure, sidewall 4 can be moved sideways from left to right in the drawing and vice versa at a right angle to its wall surface. It is connected to two bolts 10, which are fitted into and guided by a bolt bearing plate 6 having bearing bushes 14 that slidingly receive the bolts 10.

At the end of each bolt, there is a sliding cap 12, each of which touches a control element 9. The base shape of the control elements 9 on both sides is such that they form a curved guide track for the bolts 10. (See, for example, the curved guide tracks shown in the embodiment of FIG. 2.) A slide plate 8 links the two control elements 9 and can be slid at a right angle to the leaf plane.

Pressure springs 11 are disposed around the bolts 10 between the bolt bearing plate 6 and the sliding caps 12. These pressure springs ensure that the bolts 10 with their sliding caps 12 are kept pressed firmly against the control elements 9. If the sliding plate 8 is now operated, the sides of the control elements 9, each of which forms a curved guide track for the bolts 10, slide past the sliding caps 12 of the said bolts. The bolts 10 move back and forth correspondingly inside their bushings 14 and move the sidewall 4 of the box mold.

A removable texture plate 5 is attached to the inward-facing side of this wall 4. The texture 18 of the said texture plate is an imitation of any kind of natural stone as desired. It is, therefore, irregular, in order to give a nearly-natural appearance to the concrete moldings.

A wide variety of materials is suitable for making the said texture plate 5. The most suitable are, for example, polyurethane, so-called nodular iron or a common type of cast aluminum, steel or grey iron. The material for the texture plate 18 must in all events be capable of withstanding substantially high pressures, the poured concrete must not adhere to it, and the structure 18 must not be gradually eroded when the mold is filled with concrete. The newly-finished molding 1 is shown (hatched) in cross section to the left of the texture plate 5.

Inside the mold, there is a mold insert 2, which is also a negative mold for the internal surfaces visible from above when the molding 1 is finished. This insert 2 consists of steel plates having the appropriate shape, and a lid which prevents liquid concrete from entering the hollow part during mold-filling. The mechanical system described above for moving the wall 4 and the texture plate 5 are protected by a special cover plate 7 so that concrete cannot get into this area.

The plunger 3 operates upon the free area at the top of the mold. The said plunger 3 functions at the same time as a surcharge vibrator. The main vibrator works from beneath the support board.

The process according to the invention using the apparatus as portrayed above will now be described. The position at the start is that the support board 13 is free of all the devices shown in the drawing. It is disposed on a so-called board carriage preferably moved on rails. This board carriage is first moved into position beneath the apparatus so that the support board 13 is pushed onto a main vibrator and is positioned directly underneath the mold.

Now, the mold is lowered onto the support board. This is mostly done with the help of hydraulic piston-cylinder units or by purely mechanical means. The step of the lowering of the mold gives the situation as shown in FIG. 1, except for the molding 1 and the plunger 3, which have to be excluded at this stage. All the other devices, the mold insert 2, the texture plate 5 and the sidewall 4, the bolts 10, their bearing plate 6 and the pusher 8 with the control elements 9, are firmly attached to the mold.

In the situation as shown, in which the texture plate 5 is at the extreme left due to the position of the control elements 9, and the shape inside the mold is a reversal of the finished concrete molding, the mobile hopper moves across the lowered mold. The said mobile hopper, consisting basically of an open frame, moves across the covered parts of the mold as well as its cavities. A storage tank containing liquid ready-mixed concrete is located above the site of fabrication. The said storage tank has a movable segment at its lower end in the shape of a snout with an aperture, through which the concrete is poured. The snout is opened by the mobile hopper as it passes underneath the storage tank. Next occurs the movement of the mobile hopper to and fro across the mold, filling the said mold with concrete as it moves.

The plunger 3, which can be moved perpendicularly to the mold, now descends upon the concrete in the mold. In this position, as shown in FIG. 1, substantial pressure is applied to the said plunger and it begins to vibrate at the same time. From below the support board 13, the main vibrator begins to shake, together with the plunger 13 working as a surcharge vibrator. The concrete 1 in the mold is thus given ideal compression and vibration to ensure that it reaches all the angles and corners of the mold and completely fills them.

At this stage, the molding 1 is ready for de-molding. Until now, the mold was simply lifted off vertically. This is no longer possible, however, because of the textured side 18 of the concrete molding 1. Moreover, the textured side 18 of the concrete molding 1 in the example shown in FIG. 1 has an outward overhang at the top. For this reason, the next step comprises retracting the movable sidewall 4, to which the texture plate 5 is attached, at least as far to the right as the distance between the highest and lowest points of the textured structure as measured horizontally. This retraction is done in the example shown by means of moving the control elements 9. When this happens, the sliding caps 12 of the bolts 10 slip along the lateral surfaces of the said control elements 9, so that the said surfaces function as a curved guide track. The control elements 9 are moved by the slide plate 8 by means of a hydraulic cylinder-piston unit.

The pressure springs 11 press the bolts 10 as far to the right as the sliding caps 12 permit, so that the bolts pull back the sidewall 4 to the right with the texture plate 5 attached to it. The maximum height difference of the curved guide track on control element 9 must, therefore, correspond to the distance desired due to the texture of the plate 5. The retraction of the texture plate 5 releases the newly-pressed and compressed molding enough to enable the next step of the process to be carried out, which is the raising of the entire mold. The important thing here is that the bottom edges of the mold must be raised a little higher than the bottom edge of the plunger 3 so that the mold peels cleanly off the upper edges of the newly-finished molding 1.

The final step is the raising of the plunger 3, finally freeing the finished molding. The support board 13 holding the molding is pushed away from the main vibrator by the board carriage until it reaches the conveyor leading to a stacking ladder, a board storage unit which is unloaded by a special vehicle. This carries the finished moldings to special curing chambers where they are stored for curing. As soon as the board carriage has fetched a new board from a board-store and pushed it onto the vibrator, the process begins over again.

Figure 2:
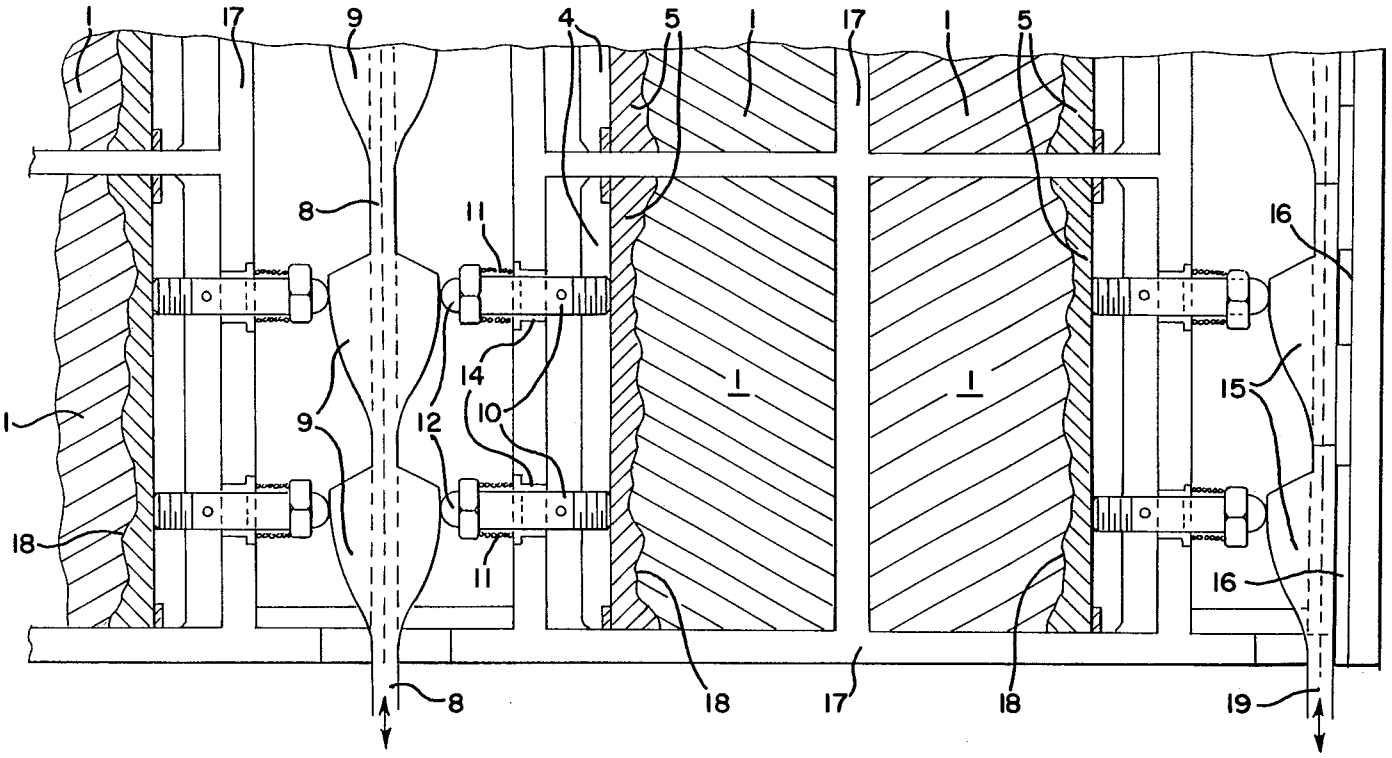
FIG. 2 is a fragmentary plan view, partly in section, showing plural movable sidewalls in use in a multiple box mold.

FIG. 2 shows a plan of the apparatus identical in principle to that shown in FIG. 1. In this case, however, it is a multiple mold 17, enabling several moldings 1 to be fabricated simultaneously in one cycle. The drawing shows only a section of this multiple mold, i.e., one of its four corner sections. It can be repeated in the same way to the left and upwards as desired, and extended as required. The left half of the diagram shows a two-way mechanical device for simultaneously moving two of the retractable sidewalls 4 facing each other. Each of these sidewalls 4 has a texture plate 5 attached to it. The control pieces 9 are arranged symmetrically along the axis of the sliding movement. There are several of these symmetrical control elements 9 in sequence, and one sliding cap 12 of a bolt 10 touches the side of each one. When the slide plate 8 is moved all the bolts to the left and right of it are displaced sychronously. This is very important because otherwise, the movable sidewalls 4 of the multiple mold 17 would jam. On the other hand, this mechanism can easily absorb pressure from the sidewalls 4 with the utmost simplicity. This pressure is generated during the compression of the concrete and works indirectly on the texture plates. The control elements 9 can absorb the reaction forces, since the said forces work on both sides thereof in opposite directions.

De-molding is also trouble-free, even though the entire mechanism is substantially jammed by the heavy pressure of the plunger 3. It is no problem for a hydraulic cylinder-piston unit to shift the slide plate 8 and release the blockage.

A mechanism working on one side only is shown on the right of FIG. 2. Here, the pressure forces are given off to the external walls of the multiple mold 17. To make the slide plates 19 easier to move, they are mounted on special sliding bearings 16 on the sidewall. The multiple mold permits simultaneous fabrication of a number of castings 1 with differing facing textures, so that, as in natural conditions, various surfaces can be produced. When prefabricated castings with various surface textures of a similar kind are built into a structure, the general appearance gives an impression of irregularity reminiscent of natural stone, and the castings are hardly recognizable as prefabricated units.

Figure 3:
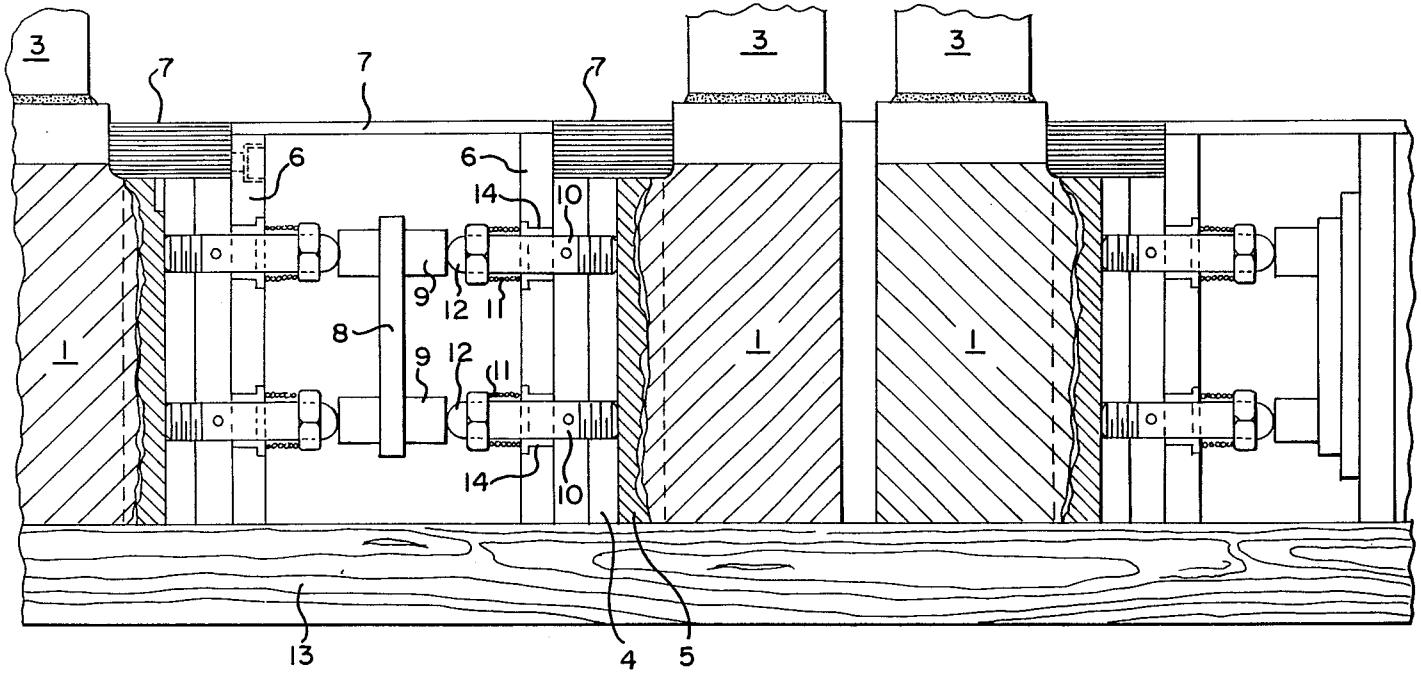
FIG. 3 is an elevation, partly in section, of the view shown in FIG. 2.

The same apparatus as just described in FIG. 2 is shown in FIG. 3 in cross-section. The plunger 3, the support board 13 and the lids 7, which prevent concrete from being poured onto the mechanisms during casting into the mold, can be seen in addition to the components already described above.

Figure 5:
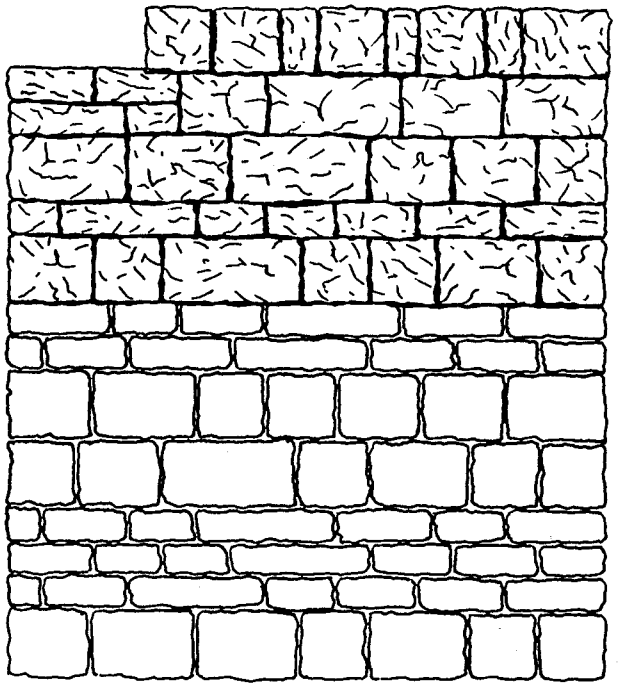
FIG. 5 is an elevation of a wall built using concrete bricks of a type shown in FIG. 4.
Figure 4:
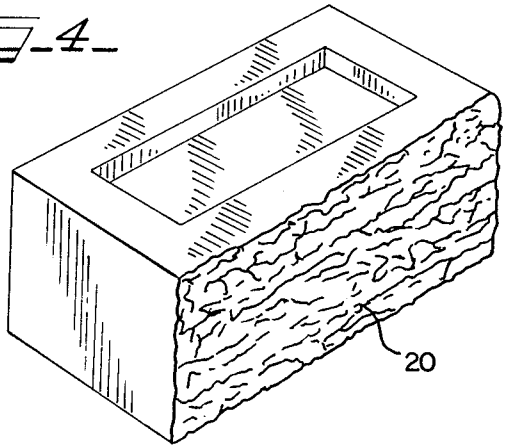
FIG. 4 is a pictorial of a first embodiment of a cast concrete brick according to the current invention.

FIG. 4 shows a casting molded according to the process of the invention as an example of the type used for building an ordinary wall. This brick has a visible surface 20 with a texture hardly distinguishable from hewn natural stone. As the multiple mold can be used to manufacture a whole range of castings with similar but varied textures, a wall built of such castings does, indeed, have a strikingly natural appearance. In FIG. 5, a wall built of such castings is shown. It is made up of several bricks of different sizes. (The bricks may be identical in size, if desired.) A range of different-sized castings like this can be produced with one multiple mold in one working cycle. If the castings are laid in varying sequence as shown here, and even inverted or placed at an angle of 90°, the already varied texture of the facings is made even more naturally irregular. A wall of this type can hardly be recognized as consisting of industrially pre-fabricated castings. However, this kind of structural element is much cheaper than hewn natural stone. Moreover, the remaining sides of the castings are nice and smooth for laying.

Figure 6:
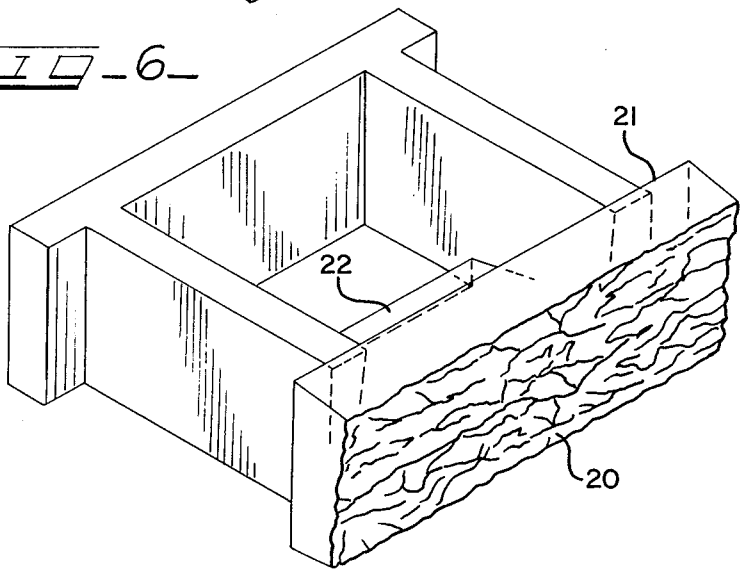
FIG. 6 is a pictorial of a second embodiment of a cast concrete brick according to the current invention.

The casting portrayed in FIG. 6 is used specially for retaining walls. It is a hollow cuboid in shape and overhangs at the front, which is textured. The front edge is raised slightly higher than the other sides to form a protuberance 21, which functions as a stop for the casting above it when they are stacked up. The cuboid has one opening in the base. However, at least one third of the base is closed at the front with a partial floor 22. The purpose of this floor is made clear by FIG. 7(*a*).

Figure 7A:
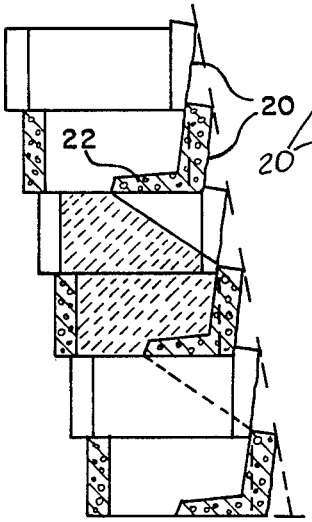
FIG. 7(*a*) is a cross-sectional elevation, taken along line 7(*a*)—7(*a*) of FIG. 7(*b*), of a retaining wall built by spacing concrete bricks at regular intervals.
Figure 7B:
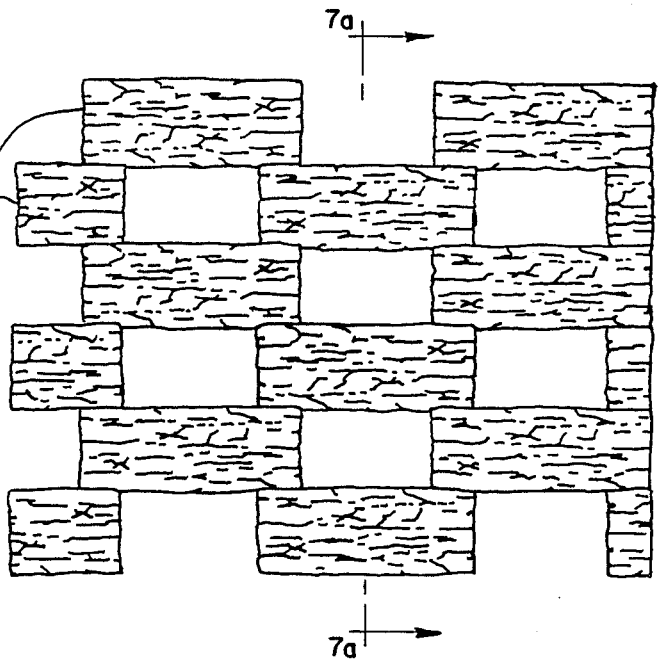

FIG. 7(*a*) shows a stacked structure of castings according to the invention for retaining a slope. The front facing of each casting is pushed forward above the one below until it reaches the stop. Stacking bricks of the proportions shown here in this way makes it possible to retain an acclivity with a slope of up to 80°. The cavities of the castings, which are like plant troughs, are filled with humus. The soil settles under the bricks, which have a partial floor, in such a way that a free space remains at the upper front of the casting below, allowing plants to be set in the earth. FIG. 7(*b*) shows a front view of the said structure. Each row of bricks is set halfway across the one below, leaving spaces for planting.

Figure 8A:
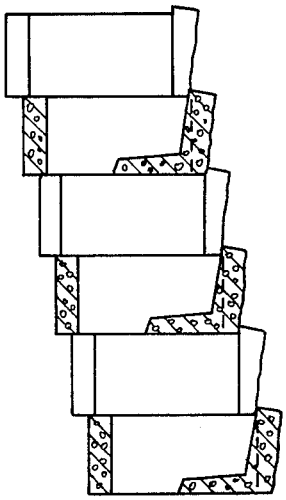
FIG. 8(*a*) is a cross-sectional elevation, taken along line 8(*a*)—8(*a*) of FIG. 8(*b*), of a retaining wall build with close-fitted bricks.
Figure 8B:
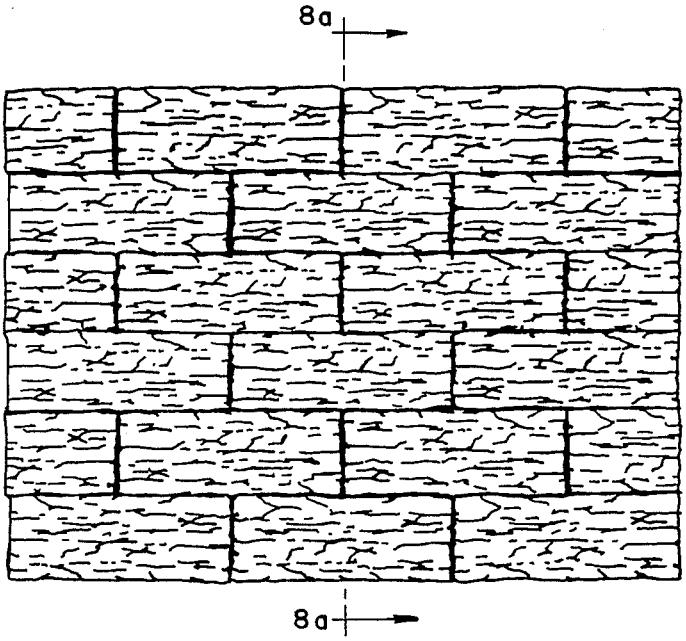

FIGS. 8(*a*) and 8(*b*) show a retaining wall constructed with the same bricks, but where the latter are laid close together with a half repeat in relation to the row below. The peculiarity of this wall is the fact that no horizontal joints are visible. Instead of horizontal joints, each row juts out a little in front of the one above it, causing the wall to recede by the thickness of what protuberance in each succeeding row. These little steps have an unusual appearance, especially when viewed from the front, and relieve the austerity of a conventional vertical wall pattern.

Figure 9:
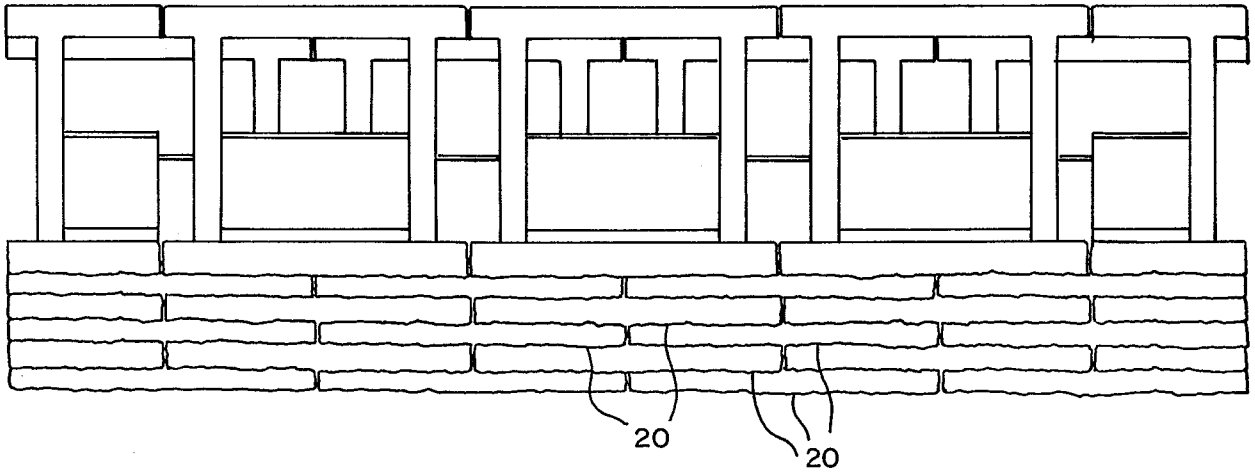
FIG. 9 is a plan view showing the rows of bricks of the wall of FIGS. 8(*a*) and 8(*b*).

FIG. 9 shows a wall similar to that shown in FIGS. 8(*a*) and 8(*b*), but seen from above, a bird's eye view. It illustrates clearly how the bricks recede from one row to the next and are laid in a half repeat. The wall can easily be filled with soil or concrete even after completion, although it has proved better in practice to fill it as work progresses.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. An apparatus for manufacturing prefabricated shaped concrete bricks comprising:

a box-shaped mold for receiving concrete, said mold adapted to rest on a support surface and having a plurality of sidewalls, at least one of said sidewalls being movable and having a textured interior surface;

plunger means for pressing the concrete into the mold from above;

means for vibrating said mold;

means for moving said movable sidewall back and forth perpendicularly to its wall surface and applying pressure to its side facing away from the mold;

means for moving said mold vertically to and from said support surface while said plunger means is stationary; and means for raising said plunger means from the concrete brick, said means for moving said movable sidewall comprising:

a bearing plate fixed relative to said mold;

at least one bolt fixed perpendicularly to the movable sidewall of said mold and facing away from said mold, said bolt slidably extending through said bearing plate and biased outwardly from the mold by means of the force of at least one pressure spring; and a cam element fixed on a slide plate, said cam element having a guide surface adapted to contact and displace said bolt when said bolt passes the cam element, thereby causing said movable sidewall to move back and forth.

2. The apparatus according to claim 1, wherein the slide plate is movable with the cam element by means of a hydraulic cylinder-piston unit.

3. The apparatus according to claim 1, further comprising a plurality of molds arranged longitudinally one behind the other, each of which have a movable sidewall with at least two bolts fixed thereon, each of said bolts adapted to contact its own cam element, said cam elements arranged sequentially on a single slide plate, whereby the cam elements can be slid perpendicularly to the bolts.

4. The apparatus according to claim 1 wherein the movable sidewall is provided with a removable textured plate on its inside surface.

5. The apparatus according to claim 4, wherein the textured plate is made of a material selected from the group consisting of polyurethane, nodular iron, cast aluminum, cast steel and grey cast iron.

* * * * *